United States Patent [19]

Penny

[11] 4,188,780

[45] Feb. 19, 1980

[54] CENTRIFUGALLY CONTROLLED FUEL SYSTEM

[75] Inventor: Robert N. Penny, Solihull, England

[73] Assignee: Noel Penny Turbines Limited, Coventry, England

[21] Appl. No.: 843,791

[22] Filed: Oct. 20, 1977

[30] Foreign Application Priority Data

Oct. 21, 1976 [GB] United Kingdom ..... 43634/76

[51] Int. Cl.[2] ..... F02C 9/04

[52] U.S. Cl. ..... 60/39.28 R; 60/745; 137/56

[58] Field of Search ..... 60/39.28 R, 39.74 S; 137/54, 56

[56] References Cited

U.S. PATENT DOCUMENTS

| | | | |
|---|---|---|---|
| 2,861,425 | 11/1958 | Williams | 137/56 |
| 3,230,719 | 1/1966 | Williams et al. | 60/39.28 R |
| 3,310,939 | 3/1967 | Curran et al. | 60/39.28 R |

FOREIGN PATENT DOCUMENTS

| | | | |
|---|---|---|---|
| 737611 | 9/1955 | United Kingdom | 60/39.74 S |

*Primary Examiner*—Louis J. Casaregola

*Attorney, Agent, or Firm*—Gifford, Chandler, VanOphem, Sheridan & Sprinkle

[57] ABSTRACT

A fuel system particularly for a gas turbine engine in which a tubular shaft rotatable during operation of the engine at engine speed or at a speed proportional thereto has a fuel inlet through which liquid fuel is introduced into the interior of the shaft, the peripheral wall of the shaft having at least one port therein communicating externally of the shaft with a combustion region of the engine and comprising a first resiliently-supported valve member mounted on the outside of the peripheral wall of the shaft in registration with the port to move away from the shaft centrifugally as the speed of rotation of the shaft increases, thereby to open the port and thus to allow fuel to flow through the port to the combustion region.

9 Claims, 7 Drawing Figures

CENTRIFUGALLY CONTROLLED FUEL SYSTEM

BACKGROUND OF THE INVENTION

The invention relates to a centrifugally controlled fuel system for use with gas turbine engines or other engines, where it is necessary to provide variable fuel flow corresponding to different operating conditions. An object of the invention is to provide a fuel system by which different predetermined fuel delivery for different rotational speeds may readily be obtained.

SUMMARY OF THE INVENTION

According to the invention, the fuel system comprises a tubular shaft arranged to be rotated at engine speed or at a speed proportional thereto and having a fuel inlet through which fuel is introduced into the interior of the shaft during operation of an engine to which the fuel is to be supplied, at least one port in the peripheral wall of the shaft communicating externally of the shaft with a combustion region of the engine, a first resiliently-supported valve member mounted on the outside of the peripheral wall of the shaft in registration with the port therein and arranged to move away from the shaft centrifugally as the speed of rotation of the shaft increases, thereby to open the port and thus to allow fuel to flow through the port to the combustion region.

Preferably several of said ports are spaced apart around the peripheral wall of the shaft and a different one of said first centrifugally-operable valve member is associated with each port. The said first centrifugally-operable valve members may be arranged to open at different speeds, whereby as the speed of rotation changes a different number of ports will be opened and hence a different flow of fuel will be admitted to the combustion region. The said first valve members may be so designed that the collective opening of the valve members will produce a predetermined relationship of fuel flow to rotational speed of the shaft.

Additionally, the or each said first valve member may be arranged to engage first overspeed stop means by which the valve member is prevented from further opening and, in which position, fuel is prevented from flowing through the associated port. The respective first overspeed stop means associated with each of the first valve members may be positioned to limit the movement of the respective first valve members at different shaft speeds, thereby to reduce the total fuel flow in accordance with a predetermined relationship between fuel flow and shaft speed. The first overspeed stop means may be defined by a cam surface, for example a shaped circumferential surface of a sleeve. The sleeve or other cam surface may be adjustable to effect variation of the operation of the first overspeed stop means. Such movement may be effected manually either as a pre-adjustment before operation of the engine or during operation of the engine, or automatically in response to a variable operational condition of the engine.

Additionally or alternatively to the provision of the first overspeed stop means, the or each port may be associated with a second centrifugally and resiliently operable valve member mounted on the inside of the shaft and which is open when the shaft is stationary and is arranged to move centrifugally to close the port at a predetermined rotational speed, thereby to act as an overspeed stop. Where there is a plurality of ports and a plurality of said first and second valve members, each second valve member may be arranged to close at a different speed greater than the speed at which the associated first valve member will open, thereby to reduce the collective fuel supply in accordance with a predetermined relationship with shaft speed, following the supply of the collective fuel supply through the ports, in accordance with a predetermined relationship to shaft speed.

By variation of the port sizes, the centrifugal characteristics of the first valve members, the settings of the first overspeed stop means, where provided, and/or the centrifugal characteristics of the second valve members, where provided, any desirable characteristic of fuel supply with shaft speed may be produced.

In a gas turbine engine, the shaft may conveniently be a main shaft of the engine, that is a shaft on which a compressor provided to supply air to the combustion region and a turbine provided to drive the compressor are mounted, although another shaft elsewhere in the engine or a shaft in a separate unit and arranged to run at the main shaft speed or a speed proportional thereto may be employed as the shaft of the aforesaid fuel system.

BRIEF DESCRIPTION OF THE DRAWINGS

By way of example, a fuel system for a gas turbine engine, in accordance with the invention, and a modification of the fuel system are now described by way of example with reference to the accompanying drawings, in which.

DESCRIPTION OF THE PREFERRED EMBODIMENTS

Figure 1:
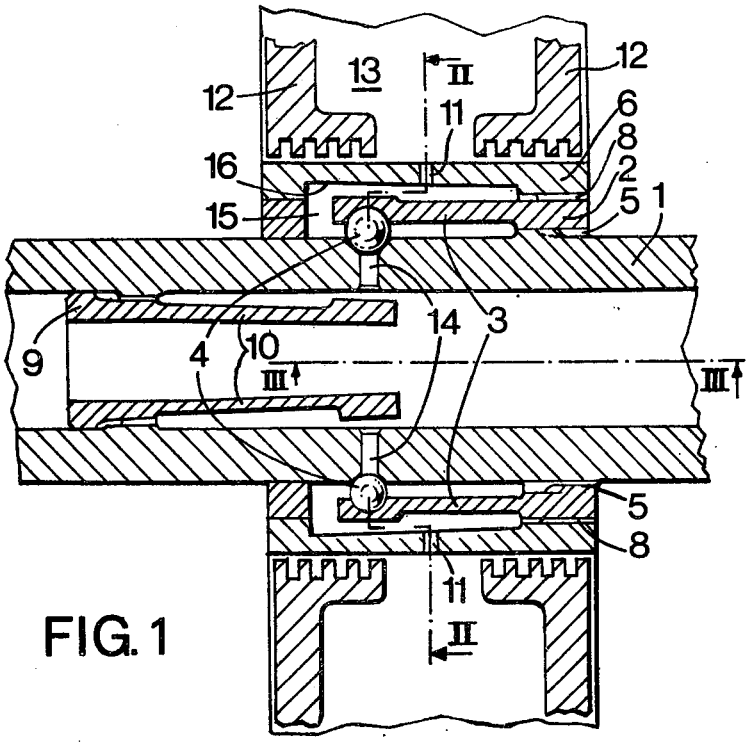
FIG. 1 is an axial section through the fuel system showing the position of valve members when the shaft is stationary.
Figure 2:
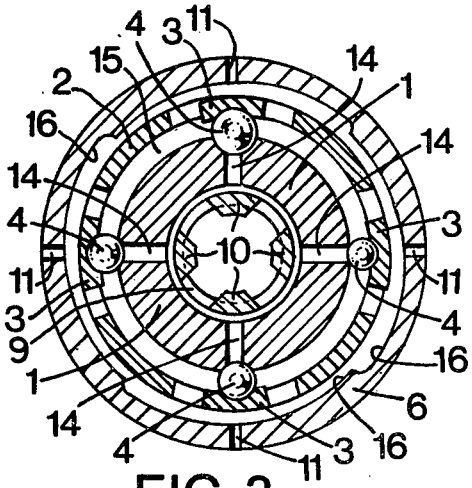
FIG. 2 is a section on the line II—II in FIG. 1.
Figure 3:
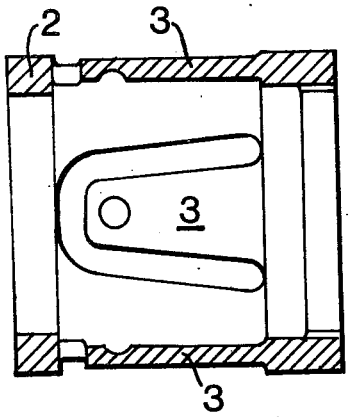
FIG. 3 is a section on the line III—III in FIG. 1 through a sleeve only, carrying the aforesaid first valve members.

Referring to FIGS. 1 and 2, the fuel system comprises a tubular shaft 1 through which liquid fuel is arranged to flow in either direction from a fuel inlet. The shaft is arranged to run co-axially within a pair of stationary walls 12 defining between them an annular combustion region 13 or a passage leading thereto. The shaft may be a main shaft of the engine on which compressor and turbine rotors (not shown) are mounted or it may be a shaft driven by the engine at the same speed or at a speed proportional to the speed of the main shaft.

The interior of the shaft 1 communicates through a plurality of valve-controlled ports 14 with an annular space 15 defined between the shaft 1 and a pair of co-axial sleeves 2 and 6 surrounding the shaft 1 and which are splined at 5 and 8 to rotate therewith co-axially within the walls 12 defining the combustion region 13. The annular space 15 communicates with the combustion region 13 through a plurality of fuel spray holes 11 in the sleeve 6. Although four holes 11 are shown in FIG. 2, any greater or smaller number, including one only, may be provided. An orifice (now shown) of a size required to determine a maximum flow of fuel to be delivered to the engine through the shaft 1 to the ports 14 and the holes 11 may be fitted in the shaft 1.

Figure 4:
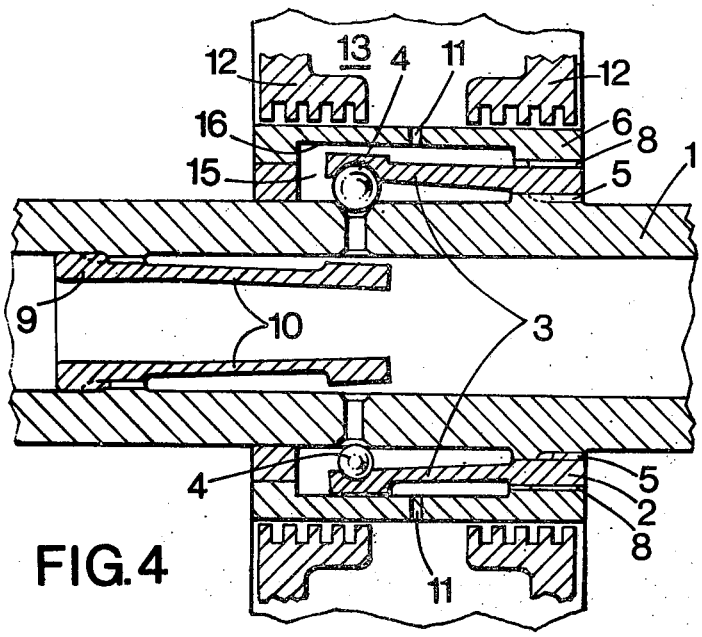
FIG. 4 is a view similar to FIG. 1 but showing typical positions of said first and second valve members at a first shaft speed.
Figure 5:
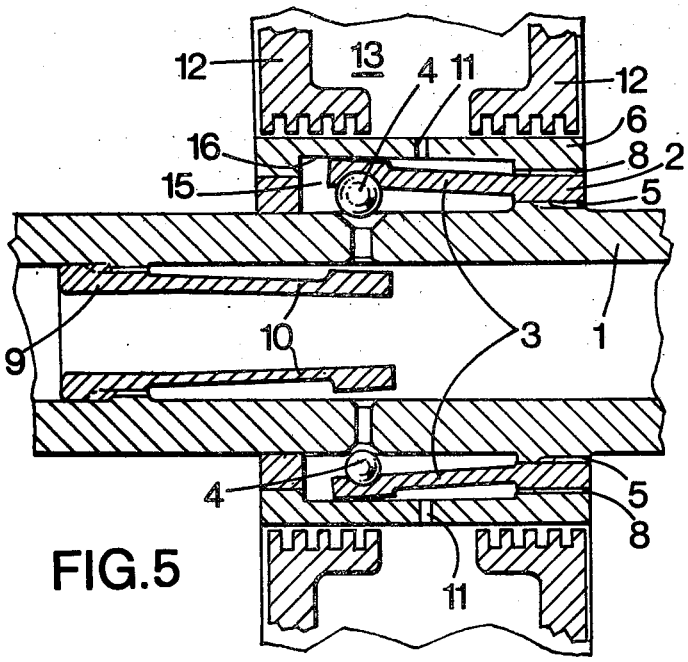
FIG. 5 is a view similar to FIGS. 1 and 4 but showing typical positions of said first and second valve members at a higher shaft speed.

The radially inner sleeve 2 carries a plurality of (e.g. four as shown) resilient blades 3, or only one blade 3, extending parallel with the axis of rotation of the shaft 1. The or each blade 3 carries a valve member arranged to close a respective port 14 when the shaft 1 is stationary or when the shaft 1 is rotating below a predetermined speed. The or each valve member is conveniently a ball 4 or semispherical member. The resilience of each blade 3, determined by the thickness of the blade, and the weight of the associated ball 4 are such that the associated ball 4 will open outwardly under centrifugal force when the shaft 1 is rotating at or above the predetermined speed of rotation. When the shaft 1 is stationary all the ports 14 are closed by the respective balls 4, but when the shaft 1, together with the sleeves 2 and 6, rotates, at or above said predetermined speed one or more of the balls 4 will open to admit fuel through the respective port or ports 14 into the annular space 15. By employing blades 3 of different thicknesses and/or balls 4 of different weights, any desired fuel flow/rotational speed relationship may be provided. For example, the fuel flow may be increased in steps by arranging for the balls 4 to open successively as the shaft speed increases. FIGS. 4 and 5 respectively show that at successively higher speeds at least one ball is open and at least one is closed (FIG. 4) and at least two balls are open (FIG. 5).

As the speed of rotation of the shaft 1 increases, each blade 3 will continue to move outwardly until its further movement is arrested by the blade 3 coming into contact with the outer sleeve 6. When each blade 3 has engaged the outer sleeve 6, the maximum fuel flow permitted by the ball 4 carried by that blade will have occurred. The maximum travel of each blade 3 and hence of the associated ball 4 may be made adjustable by providing a cam surface 16 on the inside of the outer sleeve 6 and turning or moving the sleeve 6 axially with respect to the inner sleeve 2. The splines at 8 between the outer sleeve 6 and the inner sleeve 2 may be used for axial adjustment but would not be provided where there is to be rotational adjustment of the sleeve 6. Adjustment of the outer sleeve 6 on the inner sleeve 2 may be made manually, e.g., by a lever mounted on the outer sleeve 6, either before or during operation of the engine or automatically in response to an operating condition of the engine.

The blades 3 may be of such shape that when they have reached their maximum permitted movement and have engaged the inner surface of the outer sleeve 6, the associated spray hole 11 will be closed by the respective blade 3, for example, an edge or rim on the blade 3 may completely embrace the hole 11, and so fuel in the space 15 cannot flow through the hole 11. In this way the fuel flow to the combustion region will be cut-off or progressively reduced as successive blades 3 close the respective holes 11. This provision thus provides an overspeed fuel cut-off facility.

Figure 6:
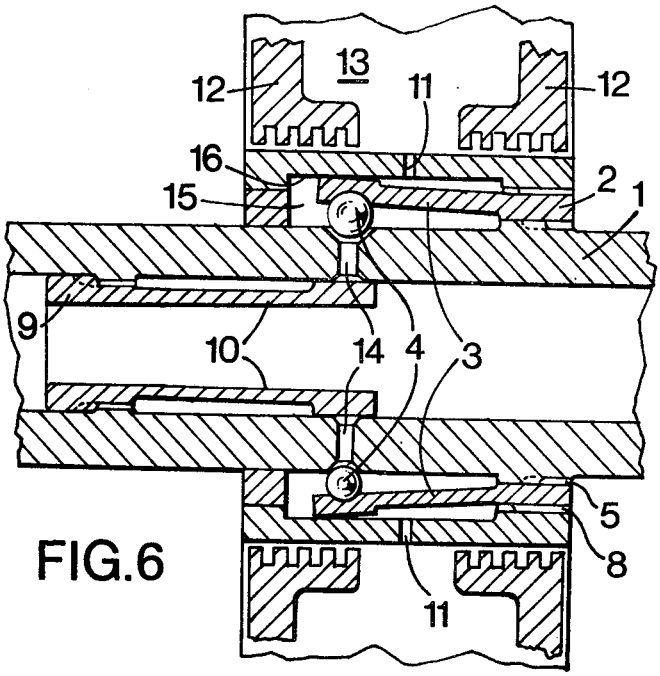
FIG. 6 is a view similar to FIGS. 1, 4 and 5 but showing all said first and second valve members closed at a still higher shaft speed.

Alternatively or additionally, another overspeed fuel cut-off device may be provided by providing, as shown in FIGS. 1,2 and 4–6, within the shaft 1 an internal sleeve 9 keyed to the shaft and provided with one or a plurality of resilient arms 10 of which the outer end portions are arranged to close the inner end of an associated port 14 at speeds greater than a predetermined speed. When the shaft 1 is stationary or is rotating at less than the predetermined speed, the arms 10 are spaced from the ports 14 as shown in FIGS. 1, 4 and 5; but when a predetermined speed has been reached the or at least one of the arms 10 will move outwardly under centrifugal force and close a respective port 14, thereby preventing fuel from entering that port 14, as shown in FIG. 6. By using arms 10 of different thickness the ports 14 can be closed successively as the shaft speed increases or all the ports 14 can be closed by the respective arms 10 substantially simultaneously when a predetermined overspeed as been reached.

Figure 7:
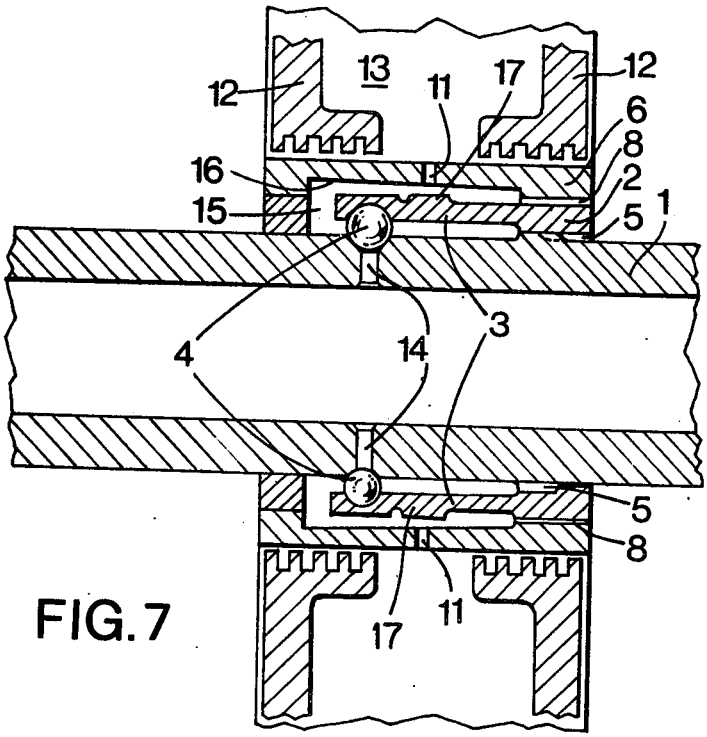
FIG. 7 is a view similar to FIG. 1 showing the aforesaid modification of the fuel system shown in FIGS. 1–6.

In some applications, either the arms 10 or the aforesaid fuel cut-off facility by the blades 3 themselves may be provided. FIG. 7 shows a modification where the arms 10 are not provided; instead a shaped portion 17 on the outside of each blade 3 would in the overspeed position close the holes 11. In other applications both overspeed facilities may be provided.

By appropriate design of the blades 3 the balls 4, and the cam surface 16, the overspeed facility provided by the blades 3 engaging the cam surface 16, where provided, and of the arms 10, where provided, any desired fuel flow characteristics with shaft speed may be provided.

What I claim as my invention and desire to secure by Letters Patent of the United States is:

1. A fuel system comprising an engine-driven tubular shaft to be rotated at engine speed or at a speed proportional thereto, a fuel inlet in the shaft and through which fuel is introduced into the interior of the shaft during operation of an engine to which the fuel is to be supplied, at least one port in the peripheral wall of the shaft communicating externally of the shaft with a combustion region of the engine, at least one first resiliently-supported valve member mounted on the outside of the peripheral wall of the shaft in registration with the port therein and movable away from the shaft centrifugally as the speed of rotation of the shaft increases to open the port and thus to allow fuel to flow through the port to the combustion region.

2. A fuel system as claimed in claim 1 in which a plurality of said ports are spaced apart around the peripheral wall of said shaft and there are an equal number of said first valve members, each said first valve member being in registration with a respective said port, a plurality of resilient blades mounted on the outside of the peripheral wall of said shaft and each resiliently supporting a respective said first valve member, each said resilient blade and associated said first valve member arranged that as the speed of rotation changes, a different number of said ports will be opened by centrifugal movement away from said shaft of said resilient blades and associated valve members and hence a different flow of fuel will be admitted to the combustion region.

3. A fuel system comprising an engine-driven tubular shaft to be rotated at engine speed or at a speed proportional thereto, a fuel inlet in the shaft and through which fuel is introduced into the interior of the shaft during operation of an engine to which the fuel is to be supplied, at least one port in the peripheral wall of the shaft communicating externally of the shaft with a combustion region of the engine, at least one first valve member arranged externally of the shaft and in registration with the port in the shaft, at least on resilient blade mounted on the outside of the peripheral wall of the shaft and resiliently supporting said first valve member, said resilient blade being movable away from the shaft centrifugally as the speed of rotation of the shaft increases thereby to permit said first valve member to move centrifugally to open the port and thus to allow fuel to flow through the port to the combustion region, and overspeed stop means with which said resilient blade is engageable to limit centrifugal movement of said resilient blade and said first valve member away from the shaft, said resilient blade when in engagement with said overspeed stop means closing the communication between the port and the combustion region to prevent fuel from flowing to the combustion region.

4. A fuel system as claimed in claim 3 in which a plurality of said ports are spaced apart around the peripheral wall of said shaft and there are an equal number of said first valve members, each said first valve member being in registration with a respective said port, each said first valve member being resiliently supported by a respective said resilient blade mounted on the outside of the peripheral wall of said shaft, each said resilient blade and associated said first valve member arranged that as the speed of rotation changes, a different number of said ports will be opened by centrifugal movement away from said shaft of said resilient blades and associated valve members and hence a different flow of fuel will be admitted to the combustion region.

5. A fuel system as claimed in claim 3 in which said overspeed stop means is defined by a cam surface.

6. A fuel system as claimed in claim 5 in which the cam surface is a shaped circumferential surface of a sleeve.

7. A fuel system as claimed in claim 5 in which the cam surface is adjustable, whereby centrifugal movement away from said shaft of said resilient blade and therefore the centrifugal movement of said valve member is limited by a variable amount.

8. A fuel system as claimed in claim 3 in which there is at least one second centrifugally and resiliently operable valve member positioned inside said shaft to close said port, at least one resilient means supporting said second valve member and mounted on the inside of said shaft, said port being open when said shaft is stationary and said second valve member movable centrifugally to close said port at a predetermined rotational speed.

9. A fuel system as claimed in claim 8 having a plurality of ports and an equal number of said first and second valve members, each said first valve member being resiliently supported by a respective said resilient blade and each said second valve member being supported by a respective said resilient means, each said resilient means arranged such that each said second valve member is movable centrifugally to close a respective said port at a different speed greater than the speed at which the associated said first valve member is movable centrifugally to open said respective port, whereby the collective fuel supply is reduced in accordance with a predetermined relationship with shaft speed, following the supply of the collective fuel supply through the ports in accordance with a predetermined relationship to shaft speed.

* * * * *

UNITED STATES PATENT AND TRADEMARK OFFICE

CERTIFICATE OF CORRECTION

PATENT NO. : 4,188,780

DATED : February 19, 1980

INVENTOR(S) : Robert Noel Penny

It is certified that error appears in the above-identified patent and that said Letters Patent are hereby corrected as shown below:

Column 5, line 3, delete "on" and insert --one-- therefor;

Signed and Sealed this

*Third* Day of *June 1980*

[SEAL]

*Attest:*

SIDNEY A. DIAMOND

*Attesting Officer*

*Commissioner of Patents and Trademarks*